United States Patent [19]

Mukunoki et al.

[11] 4,193,802

[45] Mar. 18, 1980

[54] SILVER HALIDE PHOTOGRAPHIC LIGHT-SENSITIVE MATERIAL CONTAINING AROMATIC ESTER SOLVENT

[75] Inventors: Yasuo Mukunoki; Hideki Naito; Akio Mitsui, all of Ashigara, Japan

[73] Assignee: Fuji Photo Film Co., Ltd., Ashigara, Japan

[21] Appl. No.: 933,925

[22] Filed: Aug. 15, 1978

[30] Foreign Application Priority Data

Aug. 16, 1977 [JP] Japan ..... 52/98050

[51] Int. Cl.[2] ..... G03C 1/10; G03C 1/40; G03C 1/48; G03C 1/06

[52] U.S. Cl. ..... 430/139; 430/931; 430/467; 430/470; 430/607; 430/621; 430/544; 430/634; 430/566; 430/933; 430/957

[58] Field of Search ..... 96/84 R, 84 UU, 77, 96/76 R, 95, 97, 100, 114.5, 111, 112, 82, 99

[56] References Cited

U.S. PATENT DOCUMENTS 2,322,027 6/1943 Jelley et al. ..... 96/97

*Primary Examiner*—Richard L. Schilling

*Attorney, Agent, or Firm*—Sughrue, Rothwell, Mion, Zinn & Macpeak

[57] ABSTRACT

A silver halide photographic light-sensitive material comprising a support having thereon at least one silver halide emulsion layer, with the photographic light-sensitive material having a hydrophilic organic colloid layer containing a dispersion of a scarcely water-soluble photographic additive dissolved in an aromatic ester represented by the following general formula (I):

(I)

wherein $R_1$ represents an alkyl group, an alkoxy group, an acyloxy group, an aryloxy group, an alkoxycarbonyl group or a halogen atom; $R_2$ represents a cyclic saturated hydrocarbon group; m represents an integer of 0 to 5; n represents an integer of 1 to 6; and when m and n each represents an integer of 2 or more, the substituents represented by $R_1$ or $R_2$ can be the same or different.

16 Claims, No Drawings

SILVER HALIDE PHOTOGRAPHIC LIGHT-SENSITIVE MATERIAL CONTAINING AROMATIC ESTER SOLVENT

BACKGROUND OF THE INVENTION

1. Field of the Invention

The present invention relates to a silver halide photographic light-sensitive material and, more particularly, to a silver halide photographic light-sensitive material containing a scarcely water-soluble photographic additive dispersed in a hydrophilic organic colloid layer using a specific aromatic ester.

2. Description of the Prior Art

Conventionally, a scarcely water-soluble photographic additive, for example, an oil-soluble coupler, an antioxidant for preventing color stain or color contamination, a color fading preventing agent (such as an alkylhydroquinone, an alkylphenol, a chroman, a cumarone, etc.), a hardening agent, an oil-soluble filter dye, an oil-soluble ultraviolet absorbing agent, a compound capable of releasing a development inhibitor by reaction with a developing agent (i.e., a DIR compound, such as a DIR hydroquinone, a non-color forming DIR compound, etc.), a developing agent, a dye developing agent, a compound capable of releasing a diffusible dye by self-cleavage with oxidation under alkaline conditions (i.e., a DRR compound), a compound capable of releasing a diffusible dye by coupling with a color developing agent (i.e., a DDR coupler), and the like is dissolved in an appropriate organic solvent having a high boiling point, dispersed in an aqueous solution of a hydrophilic organic colloid, particularly gelatin, in the presence of a surface active agent, and the resulting mixture is incorporated in a hydrophilic organic colloid layer, for example, a light-sensitive emulsion layer, a filter layer, a backing layer, an antihalation layer, an intermediate layer, a protective layer, and the like. In such a case, a phthalic acid ester type compound and a phosphoric acid ester type compound are particularly useful as the high boiling point organic solvent.

These types of solvents are used in producing most color and black and white light-sensitive photographic materials as solvents for a photographic additive (such as an oil-soluble incorporated type coupler, etc.). These solvents are described, for example, in U.S. Pat. Nos. 2,332,027, 2,533,514, 3,287,134, 3,748,141 and 3,779,765, German Pat. No. 1,152,610, British Pat. No. 1,272,561, German patent application (OLS) No. 2,629,842, etc. The high boiling point organic solvents of the phthalic acid ester and the phosphoric acid ester type are widely used, since these solvents are considered to be useful compounds with respect to dispersion capability for couplers, affinity to a gelatin colloid layer, influence on the stability of the color image formed, influence on the hue of the color image formed, chemical stability in photographic light-sensitive materials, low price, and the like.

However, these high boiling point organic solvents do not always fulfill all requirements such as dispersion capability for scarcely water-soluble photographic additives, affinity to an organic hydrophilic colloid layer, influence on the photographic properties, chemical stability in photographic light-sensitive materials, and the like.

For instance, certain high boiling point organic solvents have good dispersion capability but adversely affect the photographic properties (for example, the light fastness of the color image formed upon development when a photographic coupler is dispersed) and certain high boiling point organic solvents have good photographic properties but poor dispersion properties.

SUMMARY OF THE INVENTION

A first object of the present invention is to provide a photographic light-sensitive material containing a photographic additive dispersed therein using an aromatic ester which has a good dispersion capability in a hydrophilic organic colloid.

A second object of the present invention is to provide a photographic light-sensitive material that is produced using an aromatic ester which does not adversely affect the photographic properties, such as fog, sensitivity, maximum image density, etc.

A third object of the present invention is to provide a color photographic light-sensitive material that is produced using an aromatic ester with which the light fastness of the photographic color image, particularly a yellow color image, can be improved.

A fourth object of the present invention is to provide a color photographic light-sensitive material that is produced using an aromatic ester with which the occurrence of stain in the photographic color image due to humidity and heat can be prevented.

These and other objects will become apparent from the following description of the invention.

These and other objects of the present invention are attained by a silver halide photographic light-sensitive material comprising a support having thereon at least one silver halide emulsion layer with the photographic light-sensitive material having a hydrophilic organic colloid layer containing a dispersion of a scarcely water-soluble photographic additive dissolved in an aromatic ester represented by the following general formula (I):

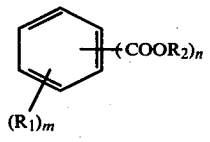

(I)

wherein $R_1$ represents an alkyl group, an alkoxy group, an acyloxy group, an aryloxy group, an alkoxycarbonyl group or a halogen atom; $R_2$ represents a cyclic saturated hydrocarbon group; m represents an integer of 0 to 5; n represents an integer of 1 to 6; and when m and n each represents an integer of 2 or more, the substituents represented by $R_1$ or $R_2$ can be the same or different.

DETAILED DESCRIPTION OF THE INVENTION

Of the substituents represented by $R_1$, an alkyl group having 1 to 12 carbon atoms which may be straight chain, branched chain or cyclic (for example, a methyl group, an ethyl group, an isopropyl group, an n-butyl group, a t-butyl group, an n-octyl group, etc.), an alkoxy group having 1 to 10 carbon atoms in which the alkyl moiety may be straight chain, branched chain or cyclic (for example, a methoxy group, an ethoxy group, an n-butoxy group, an n-octyloxy group, etc.), an acyloxy group having 1 to 20 carbon atoms in which the alkyl moiety may be straight chain, branched chain or cyclic (for example, an acetoxy group, an isobutanoyloxy group, a cyclohexanecarbonyloxy group, a dodecanoyloxy group, a cinnamoyloxy group, a benzoyloxy group, etc.), an aryloxy group having 6 to 18 carbon atoms in which the aryl moiety may be monocyclic or bicyclic (for example, a phenoxy group, a p-tolyloxy group, a 1-naphthoxy group, etc.), and an alkoxycarbonyl group in which the alkyl moiety has 1 to 18 carbon atoms and may be straight chain or branched chain and which can be substituted with one or more of a halogen atom (e.g., a chlorine atom), a phenyl group, an alkoxy group having 1 to 18 carbon atoms or an aryloxy group having 6 to 12 carbon atoms are preferred for $R_1$. These groups can be further substituted with one or more substituents, such as an alkyl group having 1 to 12 carbon atoms (e.g., as described above), a halogen atom (e.g., a chlorine atom), an alkoxy group having 1 to 10 carbon atoms (e.g., as described above), an acyloxy group having 1 to 20 carbon atoms (e.g., as described above), or an aryloxy group having 6 to 18 carbon atoms (e.g., as described above). Suitable halogen atoms for $R_1$ include a chlorine atom.

An alkyl group having 1 to 9 carbon atoms (for example, a methyl group, an ethyl group, an isopropyl group, an n-butyl group, a t-butyl group, an n-octyl group, etc.) and a chlorine atom are particularly preferred for $R_1$.

$R_2$ represents a cyclic saturated hydrocarbon group (for example, a cyclopentyl group, a cyclohexyl group, a cycloheptyl group, a cyclooctyl group, a cyclododecyl group, a menthyl group, etc.), and of the cyclic saturated hydrocarbon group represented by $R_2$, a cyclic saturated hydrocarbon group having 3 to 24 carbon atoms is preferred, and the group can be substituted with one or more substituents. Preferred substituents include an alkyl group having 1 to 18 carbon atoms which may be straight chain, branched chain or cyclic (for example, a methyl group, an ethyl group, a t-butyl group, an isopropyl group, a hexyl group, a dodecyl group, a cyclohexyl group, etc.), an alkoxy group having 1 to 18 carbon atoms in which the alkyl moiety may be straight chain, branched chain or cyclic (for example, a methoxy group, an ethoxy group, a butoxy group, etc.), a halogen atom, etc. A cyclohexyl group which may have one or more substituents is particularly preferred for $R_2$. Examples of preferred substituents are an alkyl group having 1 to 9 carbon atoms (for example, a methyl group, an ethyl group, an isopropyl group, a t-butyl group, an n-hexyl group, an n-octyl group, a cyclohexyl group, etc.), a chlorine atom, etc.

Specific examples of the aromatic esters which can be advantageously used in the present invention and are preferred are shown below. However, the present invention is not to be construed as being limited to these examples.

Compound (1)

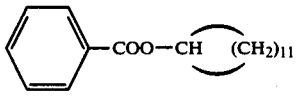

-continued

Compound (2)

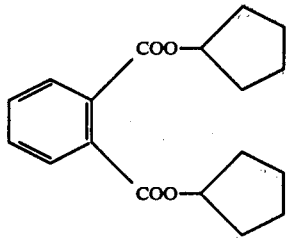

Compound (3)

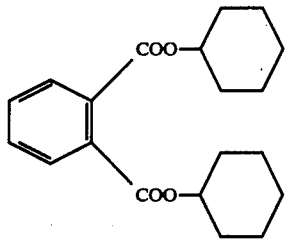

Compound (4)

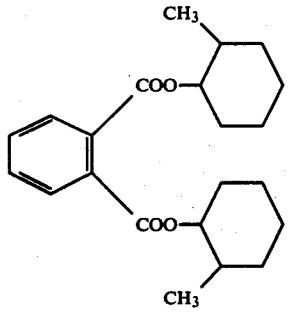

Compound (5)

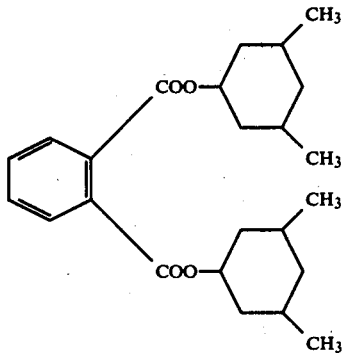

Compound (6)

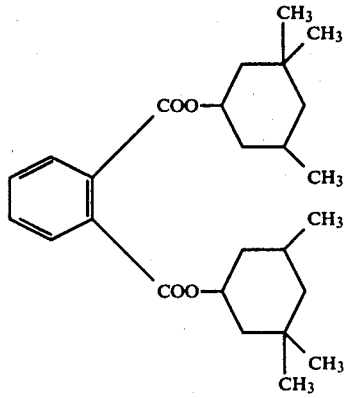

-continued
Compound (7)
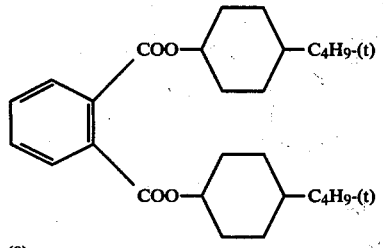
Compound (8)
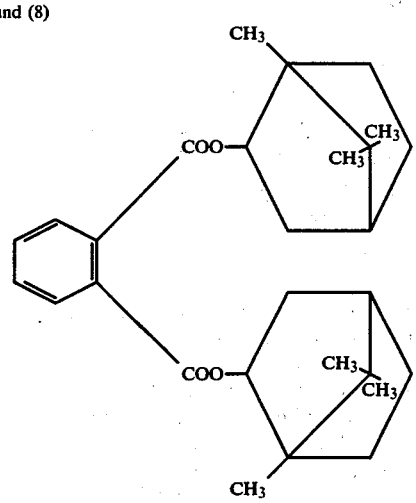
Compound (9)
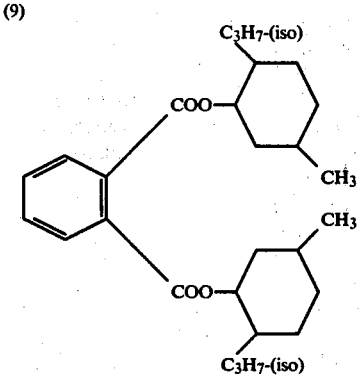
Compound (10)
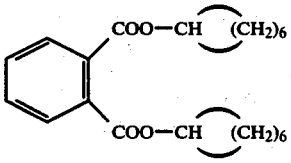
Compound (11)
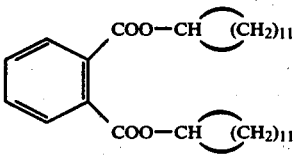
Compound (12)
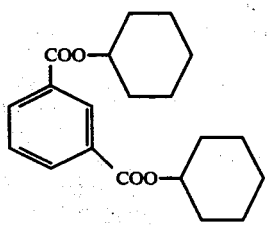
-continued
Compound (13)
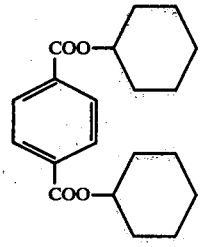
Compound (14)
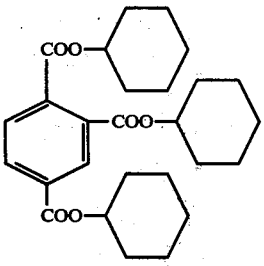
Compound (15)
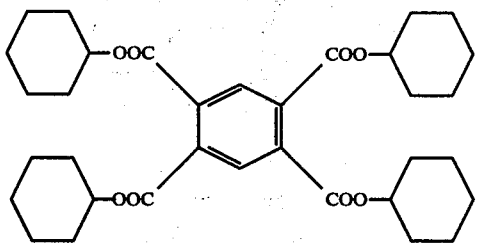
Compound (16)
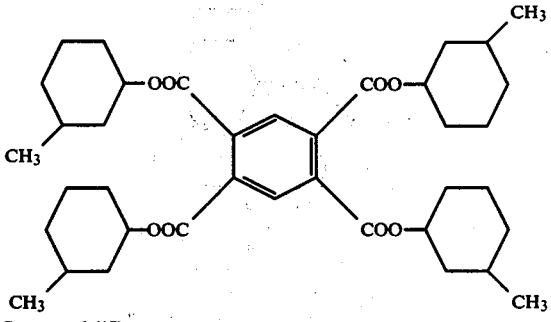
Compound (17)
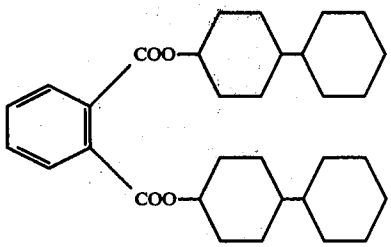
Compound (18)
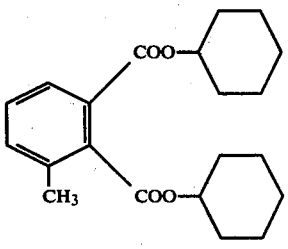

-continued

Compound (19)

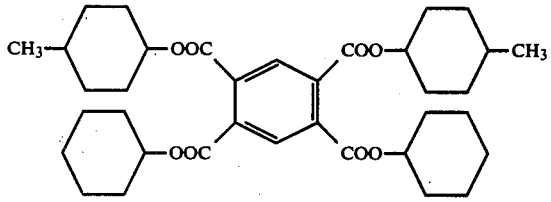

Compound (20)

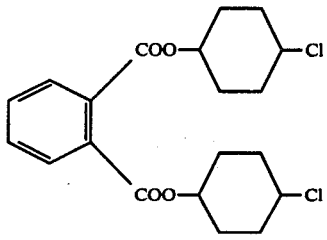

Compound (21)

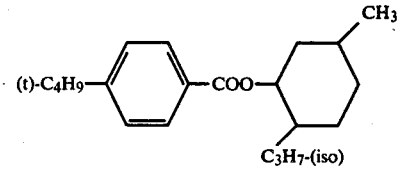

Compound (22)

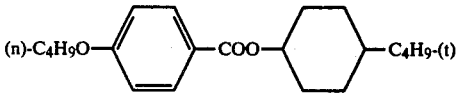

Compound (23)

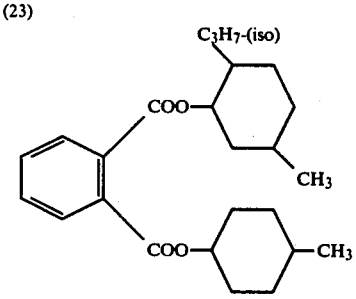

Compound (24)

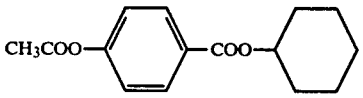

Compound (25)

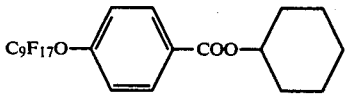

Compound (26)

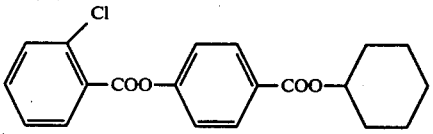

Compound (27)

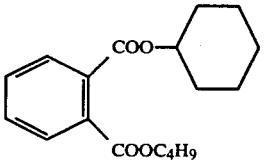

-continued

Compound (28)

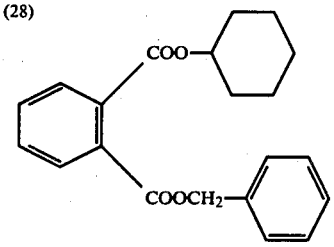

Compound (29)

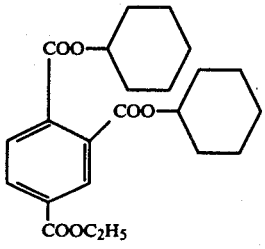

The aromatic ester used in the present invention has a boiling point above about 200° C. at normal pressure (1 atmosphere pressure).

The aromatic ester represented by the general formula (I) which can be used in the present invention can be generally obtained by dehydration reaction of an aromatic carboxylic acid or an aromatic carboxylic acid anhydride and a cyclic saturated alcohol in the presence of a catalyst (for example, sulfuric acid, p-toluenesulfonic acid, etc.), e.g., as described in U.S. Pat. Nos. 3,053,884, 3,172,904 and 3,099,682, C. E. Rehberg, *Organic Synthesis,* Vol. III, page 46 (1955) and *Tetrahedron,* 27, (4845). In this case, an azeotropic solvent for the dehydration such as benzene, toluene, xylene, etc. is used.

Alternatively, the aromatic ester can be obtained by a reaction of an aromatic carboxylic acid chloride and a cyclic saturated alcohol in the presence of an acid eliminating agent (for example, triethylamine, pyridine, etc.), e.g., as described in *Tetrahedron Letters,* 1967, 3267, *Organic Synthesis,* Vol. III, 452 (1955), *ibid.,* Vol. IV, 304 (1963), *ibid.,* Vol. III, 605 (1955) and *ibid.,* Vol. IV, 146 (1955).

Examples of the synthesis of aromatic esters represented by the general formula (I) are shown below. Unless otherwise indicated, all parts, percents, ratios and the like are by weight.

SYNTHESIS EXAMPLE 1

Synthesis of Compound (5): bis(3,5-Dimethylcyclohexyl)phthalate 100 ml of toluene was added to a mixture of 44.4 g (0.3 mol) of phthalic anhydride, 83.3 g (0.66 mol) of 3,5-dimethylcyclohexanol and 2 g of p-toluenesulfonic acid and the mixture was refluxed with heating for 12 hours with the azeotropic removal of 6 ml of water. After the reaction, the mixture was cooled and 200 ml of toluene was added to the mixture. The organic solvent layer was washed with water, a 5% aqueous solution of sodium hydroxide and water, in this order and dried with anhydrous sodium sulfate. After filtering the mixture, the filtrate was concentrated under reduced pressure. 50 ml of hexane was added to the concentrate and column chromatographed to obtain the desired compound. The carrier used was 800 g of Silica Gel 60 manufactured by Merck Co. Hexane and hexane-diethyl ether (9:1 in volume ratio) were used as the solvent and 105.7 g (yield 91.2%) of Compound (5) was obtained from the hexane-diethyl ether eluate.

$\eta_D^{30}=1.5072$

Elemental Analysis (%). Found: C: 74.60; H: 8.95. Calcd. for $C_{24}H_{34}O_4$: C: 74.57; H: 8.87.

SYNTHESIS EXAMPLE 2

Synthesis of Compound (11): Dicyclododecylphthalate

To a solution of 94.0 g (0.51 mol) of cyclododecanol, 40.3 g (0.51 mol) of pyridine and 150 ml of chloroform, 50.8 g (0.25 mol) of phthalic chloride was added dropwise with stirring for 20 minutes while maintaining the reaction temperature below 50° C. After refluxing with heating for 2 hours, the reaction mixture was cooled, the organic solvent layer was washed with water, a 5% aqueous solution of sodium hydroxide and water, in this order and dried with anhydrous sodium sulfate. After filtering the mixture, the filtrate was concentrated under reduced pressure and the residue was purified by column chromatography in the same manner as described in Synthesis Example 1. 92.1 g (yield 74.0%) of the desired compound, dicyclododecylphthalate was obtained from the hexane-diethyl ether eluate. Melting Point: 66° to 68° C.

Elemental Analysis (%). Found: C: 76.97; H: 10.26. Calcd. for $C_{32}H_{50}O_4$: C: 77.06; H: 10.11.

SYNTHESIS EXAMPLE 3

Synthesis of Compound (14): Tricyclohexyl trimellitate

A solution of 57.6 g (0.3 mol) of trimellitic anhydride, 108.2 g (1.08 mol) of cyclohexanol, 2 ml of concentrated sulfuric acid (95%) and 100 ml of benzene was refluxed with heating for 12 hours and 17 ml of water was removed by azeotropic distillation with benzene. After cooling, the organic solvent layer was washed with water, a 5% aqueous solution of sodium hydroxide and water, in this order and dried with anhydrous sodium sulfate. Column chromatography was conducted in the same manner as described in Synthesis Example 1. 81.4 g (yield 70.3%) of a colorless transparent viscous liquid was obtained.

$\eta_D^{30}=1.5230$

Elemental Analysis (%). Found: C: 70.77; H: 8.05. Calcd. for $C_{27}H_{36}O_6$: C: 71.02; H: 7.95.

SYNTHESIS EXAMPLE 4

Synthesis of Compound (15): Tetrahexylpyromellitate 100 ml of toluene was added to a mixture of 65.44 g (0.3 mol) of pyromellitic anhydride, 144.23 g (1.44 mol) of cyclohexanol and 2 ml of concentrated sulfuric acid (95%) and the mixture was refluxed with heating for 8 hours to azeotropically remove 18 ml of water. After cooling, the crystals deposited were collected by filtration and washed with water and then with hexane. The crystals were recrystallized from 200 ml of benzene whereby 76.6 g (43.8%) of needle-like crystals of the desired compound, tetrahexylpyromellitate, was obtained. Melting Point: 148°-150° C.

Elemental Analysis (%). Found: C: 70.04; H: 8.02. Calcd. for $C_{34}H_{46}O_8$: C: 70.08; H: 7.96.

The aromatic ester represented by the general formula (I) according to the present invention can be used individually or in combination as a high boiling point organic solvent for dissolving a scarcely water-soluble photographic additive or the ester can be used in combination with other known high boiling point organic solvents. A suitable amount of the other known high boiling point organic solvents is about 0 to 95 wt%.

Of the aromatic esters represented by the general formula (I), those which are solid at room temperature are preferably used in combination with known high boiling point organic solvents, for example, phthalic ester type compounds or phosphoric ester type compounds.

The amount of the aromatic ester represented by the general formula (I) which can be used ranges from about 0.05 to about 15 parts by weight, preferably from 0.1 to 6 parts by weight, per part by weight of the scarcely water-soluble photographic additive.

All compounds which have been dispersed in hydrophilic organic colloid layers using conventional high boiling point organic solvents can be advantageously employed as scarcely water-soluble photographic additives in the present invention.

Representative examples of scarcely water-soluble photographic additives are a photographic coupler which is capable of undergoing a coupling reaction with the oxidation product of an aromatic primary amine color developing agent, an antioxidant and a fading preventing agent capable of preventing color fog and fading of the color image formed, for example, an alkylhydroquinone, an alkylphenol, a chroman, a cumarone, etc., a hardening agent, a compound selectively absorbing visible light or ultraviolet light such as an oil-soluble filter dye or an oil-soluble ultraviolet absorbing agent, a fluorescent brightening agent, a DIR compound, for example, a DIR hydroquinone, a DIR coupling compound, etc., a developing agent, a DDR coupler, a DRR compound, a dye developing agent, and the like.

The aromatic ester according to the present invention can be used advantageously to disperse these scarcely water-soluble photographic additives and incorporate the additives into a hydrophilic organic colloid layer. In particular, the aromatic ester can be advantageously used for dispersing a photographic coupler and incorporating the coupler into a light-sensitive silver halide emulsion layer. That is, in photographic light-sensitive materials in which a photographic coupler is dispersed and incorporated using a phthalic acid ester type compound such as dibutyl phthalate, etc., or a phosphoric acid ester type compound such as dioctyl butyl phosphate, tricresyl phosphate, etc., the stability, in particular, light fastness of the color image formed by exposure and development processing is not sufficiently satisfactory. On the contrary, however, the stability of the color image formed is remarkably improved by using the aromatic ester according to the present invention.

In this respect, the aromatic ester according to the present invention provides extraordinary effects and these are, in particular, achieved with a yellow coupler and a cyan coupler.

The excellent effects of the aromatic ester according to the present invention will be understood from the Examples described hereinafter.

The photographic couplers which can be used in the present invention as the scarcely water-soluble photographic additive include compounds which are capable of forming a dye upon oxidative coupling with an aromatic primary amine developing agent, for example, a phenylenediamine derivative, an aminophenol derivative, etc. For instance, examples of such couplers are 5-pyrazolone couplers, pyrazolobenzimidazole couplers, cyanoacetyl cumarone couplers, open chain acylacetonitrile couplers as magenta couplers, acylacetamide couplers such as benzoylacetanilide and pivaloylacetanilide as yellow couplers, naphthol couplers, phenol couplers as cyan couplers, and the like.

Suitable magenta couplers which can be used in the present invention include those described, for example, in U.S. Pat. Nos. 2,600,788, 3,558,319, 3,935,015, 3,933,500, 3,926,631, 3,061,432, 4,012,259, 3,476,560, 3,227,550, 3,252,924, 3,311,476 and 3,419,391, British Pat. Nos. 1,293,640, German patent application (OLS) Nos. 2,015,867, 2,418,959, 2,414,832, 2,424,467, 2,510,538 and 2,526,112, Japanese patent application (OPI) Nos. 110665/1974 and 117464/1974, etc. Suitable development inhibitor releasing (DIR) couplers which can be used in the present invention include those described, for example, in U.S. Pat. Nos. 3,148,062, 3,227,554, 3,615,506 and 3,701,783, etc.

Suitable yellow couplers which can be used in the present invention include those described, for example, in U.S. Pat. Nos. 3,227,550, 3,253,924, 3,277,155, 3,265,506, 3,408,194 and 3,415,652, French Pat. Nos. 1,411,384, British Pat. Nos. 944,490, 1,040,710 and 1,118,028, German patent application (OLS) Nos. 2,057,941, 2,163,812, 2,213,461 and 2,219,971, etc. Suitable DIR yellow couplers which can be used in the present invention include those described, for example, in U.S. Pat. Nos. 3,148,062, 3,227,554 and 3,617,291, etc.

Suitable cyan couplers which can be used in the present invention include those described, for example, in U.S. Pat. Nos. 2,423,730, 3,227,550 and 3,311,476, British Pat. Nos. 1,084,480 and 1,165,563, U.S. Pat. Nos. 2,983,608, 3,005,712 and 3,034,892, British Pat. Nos. 936,621, 1,269,073, 586,211 and 627,814, French Pat. Nos. 980,372, 1,091,930, 1,257,887, 1,398,308 and 2,015,649, etc. Suitable DIR cyan couplers which can be used in the present invention include those described, for example, in British Pat. No. 1,201,110, U.S. Pat. Nos. 3,148,062, 3,227,554, 3,617,291 and 3,622,328, etc.

Non-color forming DIR coupling compounds which can be used in the present invention include those described, for example, in U.S. Pat. Nos. 3,632,345 and 3,379,529, German patent application (OLS) Nos. 2,610,546, 2,610,548 and 2,527,652, Japanese patent application (OPI) No. 72433/1976, etc.

Photographic additives suitable for use in a diffusion transfer photographic material which can be used in the present invention include, for example, diffusible dye releasing type redox compounds (DRR compounds), diffusible dye releasing type couplers (DDR couplers), dye developing agents, amidrazone compounds which release a diffusible dye upon reaction with an oxidation product of a developing agent, and the like.

In more detail, the diffusible dye releasing type redox compounds (DRR compounds) as described, for example, in Japanese patent application (OPI) Nos. 33826/1973, 126331/1974, 126332/1974 and 114930/1976, German patent application (OLS) No. 2,613,005, etc., the diffusible dye releasing couplers which release a diffusible dye upon reaction with a color developing agent (DRR couplers) as described, for example, in British Pat. Nos. 840,731, 904,364 and 1,038,331, U.S. Pat. Nos. 2,756,142, 3,227,550, 3,227,551, 3,227,554 and 3,765,886, U.S. Defensive Publication T-900,029, Japanese patent application (OPI) Nos. 123022/1974 and 133021/1976, German patent application (OLS) No. 2,630,999, etc., the amidrazone compounds which release a diffusible dye upon reaction with an oxidation product of a developing agent as described, for example, in Japanese patent No. 39165/1973, Japanese patent application (OPI) Nos. 2327/1972 and 64436/1974, etc., the dye developing agents as described, for example, in U.S. Pat. Nos. 3,953,211, 3,793,028, 3,999,991, 4,014,700, 2,983,606, 3,551,406, 3,563,739, 3,597,200, 3,674,478, 3,320,063, 3,230,082, 3,307,947, 3,579,334, 3,299,041, 2,983,605, 3,994,731, 2,992,106, 3,047,386, 3,076,808, 3,076,820, 3,077,402, 3,126,280, 3,131,061, 3,134,762, 3,134,765, 3,135,604, 3,136,605, 3,135,606, 3,135,734, 3,141,772, 3,142,565, 3,173,906, 3,183,090, 3,246,985, 3,230,086, 3,309,199, 3,230,083, 3,239,339, 3,347,672, 3,347,673, 3,245,790 and 3,230,082, German patent application (OLS) No. 2,458,212, Japanese patent application (OPI) Nos. 42536/1976, 117456/1974 and 161525/1975, etc., can be employed.

Antioxidants which can be used in the present invention as scarcely water-soluble photographic additives include phenol or hydroquinone derivatives or precursors thereof having an aliphatic group of 8 or more carbon atoms such as those compounds described, for example, in U.S. Pat. Nos. 2,336,327, 2,728,659 and 2,835,579 and Japanese patent application (OPI) No. 2128/1971.

Further, the compounds described in German Pat. No. 1,547,684, German patent application (OLS) No. 2,146,668 and Belgian Pat. No. 777,487 are particularly suitable in this invention as an antioxidant for color images.

Filter dyes which can be used as scarcely water-soluble photographic additives in the present invention include oleophilic oxonol dyes, benzotriazole type ultraviolet absorbing agents and benzophenone type ultraviolet absorbing agents such as those compounds described, for example, in Japanese Pat. Nos. 21687/1967 and 5496/1973, Japanese patent application (OPI) Nos. 1026/1972 and 2784/1971 and British Pat No. 1,293,982, etc.

The aromatic esters according to the present invention can be used in combination with a substantially water-insoluble low boiling point auxiliary solvent (such as methyl acetate, ethyl acetate, butyl acetate, and the like) or a water-soluble organic auxiliary solvent (such as methyl isobutyl ketone, $\beta$-ethoxy ethyl acetate, methyl Carbitol, methyl Cellosolve, dipropylene glycol, dimethylformamide, dioxane or the like). These low boiling point auxiliary solvents are described, for example, in U.S. Pat. Nos. 2,801,170, 2,801,171, 2,949,360 and 2,835,579. These auxiliary solvents can be removed by washing as described in U.S. Pat. Nos. 2,801,171, 2,949,360 and 3,396,027 or can be removed by vaporization as described in U.S. Pat. Nos. 2,322,027 and 2,801,171 and German patent application (OLS) No. 2,045,464.

The photographic additives such as couplers, antioxidants, filter dyes, and the like, individually or as a mixture of two or more thereof, can be dissolved in the aromatic ester solvent of the present invention and the solution dispersed in an aqueous solution of a hydrophilic colloid, particularly gelatin. In such a case, the use of one or more of the aromatic ester solvents in combination with an auxiliary solvent is particularly preferred. Useful dispersion procedures are described, for example, in U.S. Pat. Nos. 2,304,939, 2,322,027, 2,801,170, 2,801,171 and 2,949,360.

An anionic surface active agent (such as a sodium alkylbenzenesulfonate, sodium dioctylsulfosuccinate, sodium dodecyl sulfate, a sodium alkylnaphthalene sulfonate, a Fisher type coupler, and the like), an amphoteric surface active agent (such as N-tetradecyl-N,N-dipolyethylene-α-betaine, and the like), and a nonionic surface active agent (such as sorbitan monolaurate, and the like) can be used as an auxiliary dispersion agent.

The hydrophilic organic colloid layer according to the present invention can be any photographic layer containing a hydrophilic organic colloid as a binder. Examples of suitable hydrophilic organic colloids are gelatin, which is most commonly used, cellulose derivatives, sodium alginate, hydrophilic synthetic polymers (such as polyvinyl alcohol, polyvinyl pyrrolidone, polystyrene sulfonic acid, copolymers of styrene sulfonic acid, copolymers of maleic acid, copolymers of acrylic acid, copolymers of methacrylic acid, copolymers of itaconic acid, and the like), modified gelatins (such as phthalated gelatin, and the like), and the like. The above-described hydrophilic organic colloids other than gelatin can be used individually or as a mixture of two or more of such colloids, but they are conventionally used together with gelatin. The hydrophilic organic colloid layer can optionally contain a polymer latex (such as a polymethyl methacrylate latex, a polyethyl acrylate latex, and the like) to improve the physical properties of the photographic layer.

Representative examples of hydrophilic organic colloid layers include silver halide photographic light-sensitive layers and non-light-sensitive photographic auxiliary layers (such as a protective layer, an intermediate layer, a filter layer, an irradiation preventing layer, an antihalation layer, a backing layer, a development contamination preventing layer, a barrier layer, and the like).

The silver halide emulsions which can be used in the present invention are photographic emulsions containing a silver halide such as silver bromide, silver iodide, silver chloride or mixtures thereof, e.g., silver chlorobromide, silver iodobromide, and silver chloroiodobromide.

Furthermore, the color photographic light-sensitive material according to the present invention can contain, as a layer, an intermediate layer to prevent color mixing, a filter layer, a mordant dyed layer, a colored layer containing a hydrophobic dye, etc., in addition to the light-sensitive silver halide emulsion layer.

The light-sensitive silver halide emulsion used in the present invention can be coated on various kinds of supports. For example, a cellulose acetate film, a polyethylene terephthalate film, a polyethylene film, a polypropylene film, a glass plate, baryta paper, a synthetic resin laminated paper, a synthetic paper, etc., can be used.

For the photographic light-sensitive material of the present invention, a developer solution capable of reducing the exposed silver halide grains to silver can be used in processing for forming color images. In black and white development, a developer solution containing, as a developing agent, a polyhydroxy benzene, an N-alkylaminophenol, a 1-phenyl-3-pyrazolidone, or a mixture thereof can be used. Examples of suitable polyhydroxy benzenes include hydroquinone, pyrocatechol, pyrogallol, and the like. Examples of suitable N-alkylaminophenols include N-methyl-aminophenol, N-ethylaminophenol and the like. Examples of suitable 1-phenyl-3-pyrazolidones include 1-phenyl-3-pyrazolidone, 1-phenyl-4,4-dimethyl-3-pyrazolidone and the like. In color development, a developer solution containing, as a developing agent, a para-phenylenediamine derivative such as 4-amino-N,N-diethylaniline, 4-amino-3-methyl-N-methyl-N-(β-methylsulfonamidoethyl)aniline, 4-amino-3-methyl-N-ethyl-N-(β-hydroxyethyl)aniline, 4-hydroxyaniline, 4-hydroxy-2,6-dibromoaniline and the like, can be used.

The photographic light-sensitive material of the present invention can be processed at conventional processing temperatures, e.g., about 20° to 30° C., and it is also possible to process the photographic material at a higher temperature, e.g., about 30° to 60° C. or higher.

Preferred procedures for processing the color light-sensitive material according to the present invention are described, for example, in Japanese Pat. No. 35749/1970, U.S. Pat. No. 3,695,883, German patent application (OLS) Nos. 2,211,815 and 2,215,382, H. Gordon, *The British Journal of Photography*, page 558 (Nov. 15, 1954), ibid., page 440 (Sept. 9, 1955), ibid., page 2 (Jan. 6, 1956), S. Horwitz, *The British Journal of Photography*, page 212 (Apr. 22, 1960), E. Gehret, *The British Journal of Photography*, page 122 (Mar. 4, 1960), ibid., page 396 (May 7, 1965), J. Meech, *The British Journal of Photography*, page 182 (Apr. 3, 1959), German patent application (OLS) No. 2,238,051, etc. The color photographic light-sensitive material wherein the aromatic ester according to the present invention is used has an advantage in that the silver image obtained or reduced silver can be easily bleached.

The technique according to the present invention can be applied to a color negative light-sensitive material, a color reversal light-sensitive material, a color direct-positive type light-sensitive material, a transparent color positive light-sensitive material, a color paper light-sensitive material, a dye transfer (DTR) type light-sensitive material for instant photography, a color X-ray light-sensitive material, a monochromatic light-sensitive material for industrial use, etc. Further, where a developing agent, an antioxidant or a filter dye is used, the technique according to the present invention can be applied to a black and white light-sensitive material.

The color light-sensitive material of the present invention can also be a color photographic light-sensitive material in which a smaller amount of silver halide is used as is described in German patent application (OLS) No. 2,357,964, etc. For example, such a color photographic light-sensitive material containing a small amount of silver halide includes from several tenths to one hundredth (for example, about 65 to 375 mg/m$^2$ of silver halide per layer) as much silver halide as that in a conventional color photographic light-sensitive material for obtaining the same density.

The color photographic light-sensitive materials containing silver halide in such a small amount to which the present invention is applicable can be subjected to a processing method in which the developed silver formed by color development is halogenation-bleached and again color developed in order to increase the amount of dye formed, as described, for example, in U.S. Pat. Nos. 2,623,822 and 2,814,565, etc., a processing method including color intensification using a peroxide as described in U.S. Pat. Nos. 3,674,490 and 3,761,265, German patent application (OLS) No. 2,056,360, Japanese patent application (OPI) Nos. 6338/1972 and 10538/1972, etc., or using a cobalt complex salt as described in German patent application (OLS) No. 2,226,770, Japanese patent application (OPI) Nos. 9728/1973 and 9729/1973, etc.

The present invention is explained in greater detail below by reference to the following examples. However, the invention is not to be interpreted as being limited to these examples.

EXAMPLE 1

A solution prepared by heating at 70° C. a mixture of 27 g of Yellow Coupler [I], α-pivalyl-α-5,5-dimethyl-3-oxazolidinyl-2-chloro-5-[α-(2,4-di-tert-amylphenoxy)-butyramido]-acetanilide, 54 g of Compound (3) according to the present invention and 50 ml of ethyl acetate was added to 300 ml of an aqueous solution containing 50 g of gelatin and 2.0 g of sodium dodecylbenzenesulfonate and the mixture was stirred. Then the mixture was passed five times through a pre-heated colloid mill, whereby the couplers were finely dispersed together with the solvents.

All of the dispersion thus prepared was added to 1.0 kg of a photographic emulsion containing 54 g of silver iodobromide and 60 g of gelatin and 30 ml of a 5% acetone solution of triethylenephosphoramide, as a hardener, was added to the mixture. After adjusting the pH to 6.0, the mixture was coated on a cellulose triacetate film support in a dry thickness of 7.0 microns. This film was designated Sample A.

Films were prepared in the same manner as described above but using the same amount of Compounds (1), (4), (11) and (15) according to the present invention in place of Compound (3), respectively. These films were designated Samples B, C, D and E, respectively. For comparison, the same procedures as described above were repeated using the same amount of dioctyl butyl phosphate (DOBP) in place of Compound (3) to prepare a film. This film was designated Sample F.

These films were subjected to sensitometric stepwise exposure and then processed in the following manner.

| Color Processing Steps | | | |
|---|---|---|---|
| 1. | Color Development | 30° C. | 4 minutes |
| 2. | Blixing | 30° C. | 2 minutes |
| 3. | Washing | 30° C. | 2 minutes |
| 4. | Stabilizing | 30° C. | 2 minutes |

The composition of each processing solution used is described below.

| Color Developer Solution | |
|---|---|
| Sodium Metaborate | 25 g |
| Sodium Sulfite | 2 g |
| Hydroxylamine (sulfate) | 2 g |
| Potassium Bromide | 0.5 g |
| 6-Nitrobenzimidazole (borate) | 0.02 g |
| Sodium Hydroxide | 4 g |
| Benzyl Alcohol | 15.8 ml |
| Diethylene Glycol | 20 ml |
| 4-(N-Ethyl-N-β-methanesulfonamidoethyl)-amino-2-methylaniline Sesquisulfate | 8 g |
| Water to make | 1 l (pH 10.2) |
| **Blixing Solution** | |
| Ethylenediamine Tetraacetic Acid Ferric Salt | 45 g |
| Ammonium Thiocyanate | 10 g |
| Sodium Sulfite | 10 g |
| Ammonium Thiosulfate (60 wt% aq. soln.) | 100 ml |
| Sodium Ethylenediamine Tetraacetate | 5 g |
| Water to make | 1 l (pH 6.9) |
| **Stabilizing Bath** | |

-continued

| | |
|---|---|
| Tartaric Acid | 10 g |
| Zinc Sulfate | 10 g |
| Sodium Metaborate | 20 g |
| Water to make | 1 l |

The films thus-processed were subjected to light stability testing. The samples were set in a xenon fade testing device and exposed to light of $2.5\times10^6$ lux·hr for 8 days.

Then the percent decrease of the color density of the exposed sample was measured in comparison with that of the sample which had not been subjected to the light stability testing. The results of the percent decrease of the color density in the color image at an initial density of 0.50 and 1.50 are shown in Table 1 below.

Table 1

| Percent Decrease in Color Density | | | |
|---|---|---|---|
| | | Initial Density | |
| Sample | Compound | 0.50 (%) | 1.50 (%) |
| A | (3) | 24 | 12 |
| B | (1) | 29 | 24 |
| C | (4) | 27 | 19 |
| D | (11) | 27 | 15 |
| E | (15) | 25 | 17 |
| F (comparison) | DOBP | 62 | 44 |

As is apparent from the results shown in Table 1 above, in Sample F wherein the couplers were dispersed using DOBP, the light fading of the color image was severely observed. On the other hand, the light stability of the color image was extremely improved in Samples A to E according to the present invention.

EXAMPLE 2

In the same manner as described in Example 1 but using 27 g of Compound (3) and 27 g of DOBP, 27 g of Compound (3) and 27 g of dibutyl phthalate (DBP) and only 27 g of DOBP in place of 54 g of Compound (3), Samples G, H and I were prepared, respectively. Light stability testing was conducted in the same manner as described in Example 1 and the results shown in Table 2 below were obtained.

Table 2

| | | Initial Density | |
|---|---|---|---|
| Sample | Compound | 0.50 (%) | 1.50 (%) |
| G | (3) + DOBP | 34 | 24 |
| H | (3) + DBP | 35 | 26 |
| I (comparison) | DOBP | 42 | 32 |

EXAMPLE 3

Using a solution prepared by heating at 70° C. a mixture of 19.1 g of Cyan Coupler [II] having the formula

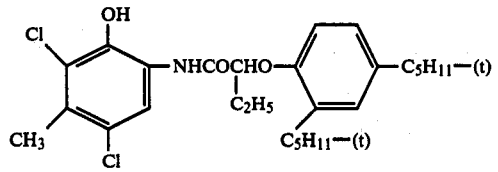

12.4 g of Compound (3) according to the present invention and 40 ml of ethyl acetate, the same procedure as described in Example 1 was repeated to prepare Sample J.

For comparison, Sample K was prepared using the same weight of DOBP in place of Compound (3).

The processed samples were produced in the same manner as described in Example 1 and the fastness after storage in the dark at 100° C. for 1 week and the fastness after storage in the dark at 60° C. and 75% RH for 6 weeks were determined. The percent decrease in density (%) based on the initial density thus obtained is shown in Table 3 below.

Table 3

| | 100° C. for 1 Week | | 60° C., 75% RH for 6 Weeks | |
|---|---|---|---|---|
| Sample | $D_{0.5}$ (%) | $D_{1.5}$ (%) | $D_{0.5}$ (%) | $D_{1.5}$ (%) |
| J | 35 | 38 | 9 | 10 |
| K | 41 | 46 | 13 | 15 |

From the results shown above, it is apparent that color images having a good fastness to light, heat and humidity are formed when the aromatic ester according to the present invention is used.

EXAMPLE 4

On a paper support with polyethylene layers laminated on both sides thereof were coated the following First Layer (as the lowermost layer) to the Sixth Layer (as the uppermost layer) to prepare a multilayer color light-sensitive material [Sample L]. (In the following table, mg/m² represents the amount coated.)

| | | |
|---|---|---|
| Sixth Layer (protective layer) | Gelatin | 1,5000 mg/m² |
| Fifth Layer (red-sensitive layer | Silver Chlorobromide Emulsion (AgBr: 50 mol %, 300 mg silver/m²) | |
| | Gelatin | 1,500 mg/m² |
| | Cyan Coupler *1 | 500 mg/m² |
| | Coupler Solvent *2 | 250 mg/m² |
| Fourth Layer (UV-light absorbing layer) | Gelatin | 1,200 mg/m² |
| | UV Light-Absorbing Agent *3 | 1,000 mg/m² |
| | Solvent for UV Light-Absorbing Agent *2 | 250 mg/m² |
| Third Layer (green-sensitive layer) | Silver Chlorobromide Emulsion (AgBr: 50 mol %, 450 mg silver/m²) | |
| | Gelatin | 1,500 mg/m² |
| | Magenta Coupler *4 | 400 mg/m² |
| | Coupler Solvent *5 | 200 mg/m² |
| Second Layer | Gelatin | 1,000 mg/m² |
| First Layer | Silver Chlorobromide Emulsion (AgBr: 80 mol %, 450 mg silver/m²) | |
| | Gelatin | 1,500 mg/m² |
| | Yellow Coupler *6 | 500 mg/m² |
| | Coupler Solvent *7 | 500 mg/m² |

-continued

| Support | Polyethylene Laminated Paper |
|---|---|

*1 Cyan Coupler: 2-[α-(2,4-Di-t-amylphenoxy)butanamido]-4,6-dichloro-5-methylphenol
*2 Coupler Solvent: Di-n-butyl phthalate
*3 UV Light-Absorbing Agent: 2-(2-Hydroxy-3-sec-butyl-5-t-butylphenyl)-benzotriazole
*4 Magenta Coupler: 1-(2,4,6-Trichlorophenyl)-3-(2-chloro-5-tetradecanamido)anilino-2-pyrazolin-5-one
*5 Coupler Solvent: Tricresyl phosphate
*6 Yellow Coupler: α-Pivaloyl-α-(2,4-dioxo-5,5'-dimethyl-oxazolidin-3-yl)-2-chloro-5-[α-(2,4-di-t-amylphenyoxy)butanamidoacetanilide
*7 Coupler Solvent: o-Dioctylbutyl phosphate Using Compound (3) according to the present invention in place of the coupler solvent in the First Layer of Sample L, Sample M was prepared. In Sample M, the weight ratio of the yellow coupler to the coupler solvent was 1:1 as in Sample L for comparison.

Each sample was exposed for ½ second to blue light, green light and red light through a continuous wedge, and then processed in the following manner.

| Step | Time | Temperature |
|---|---|---|
| Color Development | 3 min 30 sec | 33° C. |
| Bleach-Fixing | 1 min 30 sec | " |
| Washing | 2 min | " |
| Drying | | |

The processing solutions used had the following compositions.

| | |
|---|---|
| Color Development Solution | |
| Benzyl Alcohol | 15 ml |
| Sodium Sulfite | 5 g |
| Potassium Bromide | 0.5 g |
| Hydroxylamine Sulfate | 2.0 g |
| Sodium Carbonate | 30.0 g |
| Sodium Nitrilotriacetate | 2.0 g |
| 4-Amino-3-methyl-N-(β-methanesulfonamido)-ethylaniline | 5.0 g |
| Water to make | 1,000 ml (pH 10.1) |
| Bleach-Fixing Solution | |
| Ammonium Thiosulfate | 105 g |
| Sodium Sulfite | 2 g |
| Disodium Ethylenediaminetetraacetate | 40 g |
| Sodium Carbonate (monohydrate) | 5 g |
| Water to make | 1,000 ml (ph 7.0) |

The samples thus processed were subjected to light stability testing using a xenon fade testing device ($2.0\times10^6$ lux − 140 hr.). The color density of the image after 140 hours at an initial density of 1.5 and 0.5 was measured and the percent decrease in color density obtained is shown in Table 4 below.

Table 4

| | | Initial Density | |
|---|---|---|---|
| Sample | Compound | 0.50 (%) | 1.50 (%) |
| L (comparison) | DOBP | 58 | 50 |
| M (present invention) | (3) | 30 | 18 |

From the results shown above, it is apparent that excellent photographic properties are obtained and color images having a good fastness to light are formed. Similar results were obtained when Compounds (5), (9), (11), (17), (19) or (24) were used in place of Compound (3), respectively.

While the invention has been described in detail and with reference to specific embodiments thereof, it will be apparent to one skilled in the art that various changes and modifications can be made therein without departing from the spirit and scope thereof.

What is claimed is:

1. A silver halide photographic light-sensitive material comprising a support having thereon at least one silver halide emulsion layer with the photographic light-sensitive material having a hydrophilic organic colloid layer containing a dispersion of a scarcely water-soluble photographic additive dissolved in an aromatic ester represented by the following general formula (I):

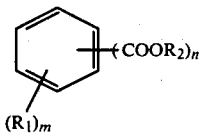

(I)

wherein $R_1$ represents an alkyl group, an alkoxy group, an acyloxy group, an aryloxy group, an alkoxycarbonyl group or a halogen atom; $R_2$ represents a cyclic saturated hydrocarbon group; m represents an integer of 0 to 5; n represents an integer of 1 to 6; and when m and n each represents an integer of 2 or more, the substituents represented by $R_1$ or $R_2$ can be the same or different.

2. The silver halide photographic light-sensitive material as claimed in claim 1, wherein $R_1$ represents an alkyl group having 1 to 12 carbon atoms, an alkoxy group having 1 to 10 carbon atoms, an acyloxy group having 1 to 20 carbon atoms, an aryloxy group having 6 to 18 carbon atoms or an alkoxycarbonyl group in which the alkyl moiety has 1 to 18 carbon atoms.

3. The silver halide photographic light-sensitive material as claimed in claim 1, wherein $R_1$ represents an alkyl group having 1 to 9 carbon atoms or a chlorine atom.

4. The silver halide photographic light-sensitive material as claimed in claim 1, wherein $R_2$ represents a cyclic saturated hydrocarbon group having 3 to 24 carbon atoms.

5. The silver halide photographic light-sensitive material as claimed in claim 4, wherein $R_2$ represents a cyclohexyl group.

6. The silver halide photographic light-sensitive material as claimed in claim 1, wherein said scarcely water-soluble photographic additive is a photographic coupler, an antioxidant, a fade preventing agent, a hardener, an oil-soluble filter dye, an oil-soluble ultraviolet absorbing agent, a fluorescent brightening agent, a development inhibitor releasing compound, a developing agent, a diffusible dye releasing coupler, a diffusible dye releasing redox compound or a dye developing agent.

7. The silver halide photographic light-sensitive material as claimed in claim 6, wherein said scarcely water-soluble photographic additive is a photographic coupler.

8. The silver halide photographic light-sensitive material as claimed in claim 7, wherein said photographic coupler is a yellow coupler or a cyan coupler.

9. The silver halide photographic light-sensitive material as claimed in claim 1, wherein said aromatic ester is present in an amount of 0.05 to 15 parts by weight per part by weight of said scarcely water-soluble photographic additive.

10. The silver halide photographic light-sensitive material as claimed in claim 1, wherein said scarcely water-soluble photographic additive is a photographic coupler and said dispersion of said photographic coupler in said aromatic ester represented by the general formula (I) is present in a light-sensitive silver halide emulsion layer.

11. The silver halide photographic light-sensitive material as claimed in claim 1, wherein said hydrophilic organic colloid layer is a gelatin layer.

12. The silver halide photographic light-sensitive material as claimed in claim 9, wherein said hydrophilic organic colloid layer is a gelatin layer.

13. The silver halide photographic light-sensitive material as claimed in claim 12, wherein said compound is:

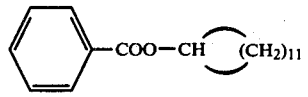

14. The silver halide photographic light-sensitive material as claimed in claim 12, wherein said compound is:

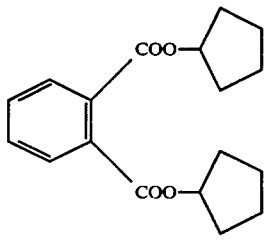

15. The silver halide photographic light-sensitive material as claimed in claim 12, wherein in said general formula (I) m is 0.

16. The silver halide photographic light-sensitive material as claimed in claim 12, wherein said scarcely water-soluble additive is a yellow coupler.

* * * * *